US010089880B2

(12) United States Patent
Bender et al.

(10) Patent No.: US 10,089,880 B2
(45) Date of Patent: Oct. 2, 2018

(54) WARNING DRIVER OF INTENT OF OTHERS

(71) Applicant: International Business Machines Corporation, Armonk, NY (US)

(72) Inventors: Michael Bender, Rye Brook, NY (US); Edward T. Childress, Austin, TX (US); Rhonda L. Childress, Austin, TX (US); Donald L. Muchmore, Superior, CO (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 15/346,280

(22) Filed: Nov. 8, 2016

(65) Prior Publication Data

US 2018/0130354 A1 May 10, 2018

(51) Int. Cl.
*G08G 1/09* (2006.01)
*G08G 1/16* (2006.01)

(52) U.S. Cl.
CPC ..... *G08G 1/166* (2013.01)

(58) Field of Classification Search
None
See application file for complete search history.

(56) References Cited

U.S. PATENT DOCUMENTS 7,095,318 B1 8/2006 Bekhor
8,604,932 B2 * 12/2013 Breed ..... B60J 10/00 340/576
9,050,935 B2 6/2015 Stefan et al.
9,092,987 B2 * 7/2015 Bone ..... G08G 1/167
9,105,190 B2 * 8/2015 Akiyama ..... G08G 1/165
9,159,023 B2 10/2015 Bone et al.
9,177,477 B2 11/2015 Mochizuki et al.
9,193,314 B1 * 11/2015 Graham ..... B60W 50/085
9,358,984 B2 6/2016 Silvlin
9,701,307 B1 * 7/2017 Newman ..... B60W 30/09
(Continued)

FOREIGN PATENT DOCUMENTS

CN 103640532 A 3/2014
WO 2013177407 A1 11/2013
WO 2014172323 A1 10/2014

OTHER PUBLICATIONS

"Tradeoff Analytics | IBM Watson Developer Cloud", retrieved from http://www.ibm.com/watson/developercloud/tradeoff-analytics.html; as early as 2016.

(Continued)

*Primary Examiner* — Curtis King
*Assistant Examiner* — Chico A Foxx
(74) *Attorney, Agent, or Firm* — Brown & Michaels, PC; John Pivnichny

(57) ABSTRACT

A driver action system for monitoring traffic and capturing specific information about the car and the driver from a GPS device and other IoT sensors. Driver history and tendencies can provide insight into a driver's intention while on the road. The system will analyze the collected information and broadcast an alert to other drivers in the same area. A broadcast to the other devices or users in the area would include the probability or percentage of the driver taking a particular action or a lack of familiarity with the area.

18 Claims, 5 Drawing Sheets

(56) References Cited

U.S. PATENT DOCUMENTS

2005/0102098 A1* 5/2005 Montealegre ..... G01C 21/32 701/533
2006/0125616 A1 6/2006 Song
2007/0124063 A1* 5/2007 Kindo ..... G01C 21/26 701/517
2009/0234552 A1* 9/2009 Takeda ..... B60W 30/16 701/96
2009/0267750 A1* 10/2009 Konishi ..... G08G 1/163 340/435
2010/0007523 A1* 1/2010 Hatav ..... G01C 21/26 340/901
2012/0330542 A1* 12/2012 Hafner ..... G08G 1/163 701/301
2013/0226408 A1* 8/2013 Fung ..... B60W 40/09 701/41
2013/0278442 A1* 10/2013 Rubin ..... G08G 9/02 340/905
2013/0297097 A1 11/2013 Fischer et al.
2013/0316311 A1 11/2013 England
2014/0067250 A1* 3/2014 Bone ..... G08G 1/167 701/301
2014/0129080 A1 5/2014 Leibowitz et al.
2014/0180563 A1* 6/2014 Simon ..... G08G 1/166 701/118
2014/0277830 A1* 9/2014 Kwon ..... B60W 50/14 701/1
2014/0278586 A1 9/2014 Sanchez et al.
2014/0309849 A1 10/2014 Ricci
2015/0112504 A1 4/2015 Binion et al.
2015/0141043 A1* 5/2015 Abramson ..... G01C 21/34 455/456.1
2016/0001781 A1* 1/2016 Fung ..... G06F 19/345 701/36
2016/0039426 A1 2/2016 Ricci
2016/0046294 A1* 2/2016 Lee ..... B60W 40/08 340/576
2016/0378104 A1* 12/2016 Hiei ..... B60Q 9/00 701/2
2017/0039479 A1* 2/2017 Chen ..... G06N 7/005
2017/0084174 A1* 3/2017 Suzuki ..... B60W 30/00
2017/0088167 A1* 3/2017 Fujii ..... B62D 6/002
2017/0169709 A1* 6/2017 Ando ..... G08G 1/161
2017/0186320 A1* 6/2017 Lai ..... G08G 1/164
2017/0191847 A1* 7/2017 Chintakindi ..... G01C 21/3667
2017/0243485 A1* 8/2017 Rubin ..... G08G 1/096791
2017/0248949 A1* 8/2017 Moran ..... G05D 1/0055
2017/0248950 A1* 8/2017 Moran ..... G05D 1/0055
2017/0305434 A1* 10/2017 Ratnasingam ..... B60W 40/09

OTHER PUBLICATIONS

"Easy analytics | Home | IBM Watson Analytics", retrieved from https://www.ibm.com/analytics/watson-analytics/us-en/; as early as 2016.

* cited by examiner

WARNING DRIVER OF INTENT OF OTHERS

BACKGROUND

The present invention relates to a system for warning drivers, and more specifically to a system for warning drivers of the possible intent of others on the road.

Defensive driving starts with understanding the environment one is presently in, including the plans or intentions of other drivers.

SUMMARY

According to one embodiment of the present invention, a method of warning drivers of intent of other drivers in an area is disclosed. The method comprising the steps of: a computer detecting a location of a vehicle and a first driver in real time; the computer monitoring traffic and road conditions in the location of the vehicle in real time; the computer analyzing information collected during monitoring via cognitive analysis to determine at least one driver pattern of the first driver and generate a driver probability representing driver actions of the first driver for a given location across multiple dimensions; and if the driver probability is greater than a threshold, sending a warning regarding the driver pattern to at least one second driver in the location which may be impacted by the first driver.

According to another embodiment of the present invention a computer program product for warning driver of intent of other drivers in an area is disclosed. The computer program product comprising a computer comprising at least one processor, one or more memories, one or more computer readable storage media, the computer program product comprising a computer readable storage medium having program instructions embodied therewith. The program instructions executable by the computer to perform a method comprising: detecting, by the computer, a location of a vehicle and a first driver in real time; monitoring, by the computer, traffic and road conditions in the location of the vehicle in real time; analyzing, by the computer, information collected during monitoring via cognitive analysis to determine at least one driver pattern of the first driver and generate a driver probability representing driver actions of the first driver for a given location across multiple dimensions; and if the driver probability is greater than a threshold, sending, by the computer, a warning regarding the driver pattern to at least one second driver in the location which may be impacted by the first driver.

According to another embodiment of the present invention a computer system for warning drivers of intent of other drivers in an area is disclosed. The computer system comprising a computer comprising at least one processor, one or more memories, one or more computer readable storage media having program instructions executable by the computer to perform the program instructions. The program instructions comprising: detecting, by the computer, a location of a vehicle and a first driver in real time; monitoring, by the computer, traffic and road conditions in the location of the vehicle in real time; analyzing, by the computer, information collected during monitoring via cognitive analysis to determine at least one driver pattern of the first driver and generate a driver probability representing driver actions of the first driver for a given location across multiple dimensions; and if the driver probability is greater than a threshold, sending, by the computer, a warning regarding the driver pattern to at least one second driver in the location which may be impacted by the first driver.

DETAILED DESCRIPTION

Figure 1:
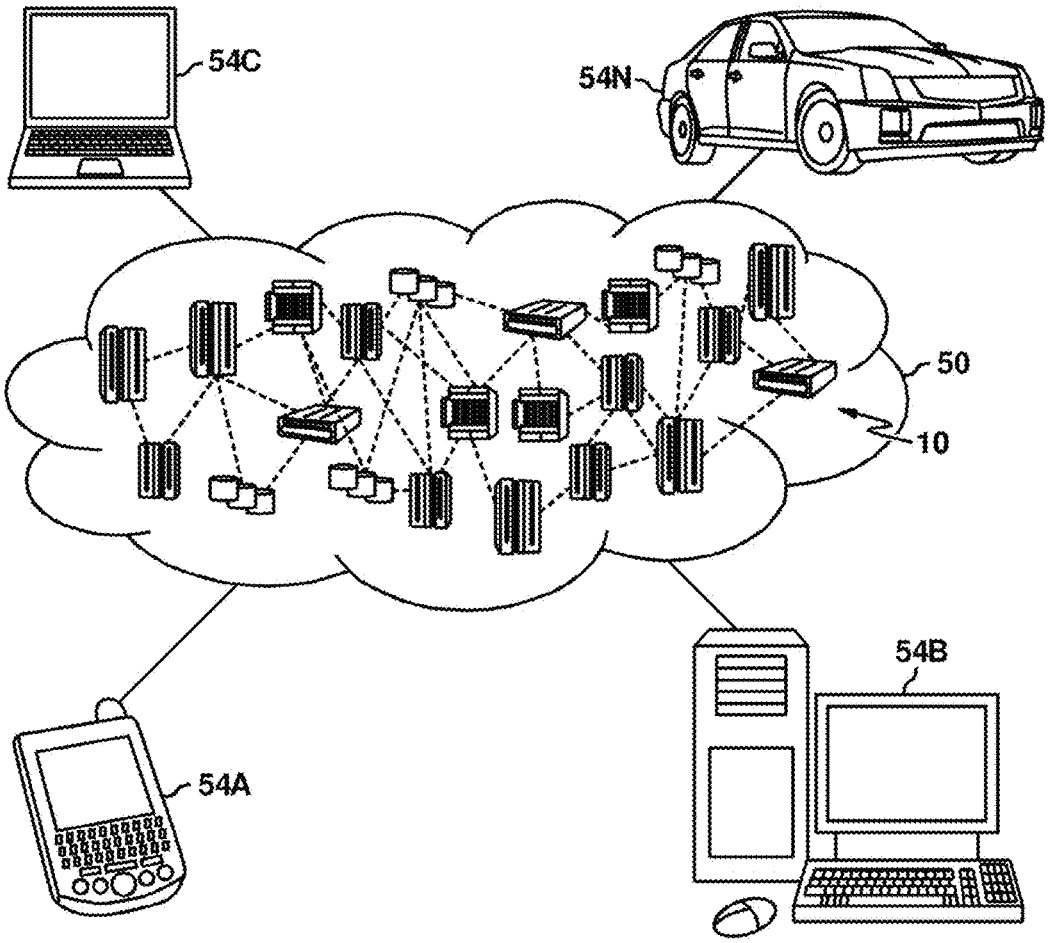
FIG. 1 depicts a cloud computing node according to an embodiment of the present invention.

In an embodiment of the present invention, a system, for example a driver action system, monitors traffic and captures specific information about the car and the driver from a global positioning system (GPS) receiver and other IoT (Internet of Things) sensors. Driver history and tendencies can provide insight into a driver's intention while on the road. The system will analyze the collected information and broadcast an alert to other drivers in the same area. Several events will be monitored such as; people looking in side mirrors, use of blinkers, driver hugging the line showing intent, driving habits based on geography, etc. Sensors will be used to obtain event information and store the information in the cloud for cognitive analysis. A broadcast to the other devices or users in the area would include the probability or percentage of the driver taking a particular action or a lack of familiarity with the area, which could imply the driver would make a last minute adjustment because they don't know where to go.

It is to be understood that although this disclosure includes a detailed description on cloud computing, implementation of the teachings recited herein are not limited to a cloud computing environment. Rather, embodiments of the present invention are capable of being implemented in conjunction with any other type of computing environment now known or later developed.

Cloud computing is a model of service delivery for enabling convenient, on-demand network access to a shared pool of configurable computing resources (e.g., networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models Characteristics are as Follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported, providing transparency for both the provider and consumer of the utilized service.

Service Models are as Follows:

Software as a Service (SaaS): the capability provided to the consumer is to use the provider's applications running on a cloud infrastructure. The applications are accessible from various client devices through a thin client interface such as a web browser (e.g., web-based e-mail). The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as Follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure that includes a network of interconnected nodes.

Referring now to FIG. 1, illustrative cloud computing environment 50 is depicted. As shown, cloud computing environment 50 includes one or more cloud computing nodes 10 with which local computing devices used by cloud consumers, such as, for example, personal digital assistant (PDA) or cellular telephone 54A, desktop computer 54B, laptop computer 54C, and/or automobile computer system 54N may communicate. The automobile computer system 54N may include a driver action system 210 and a GPS receiver 215. Nodes 10 may communicate with one another. They may be grouped (not shown) physically or virtually, in one or more networks, such as Private, Community, Public, or Hybrid clouds as described hereinabove, or a combination thereof. This allows cloud computing environment 50 to offer infrastructure, platforms and/or software as services for which a cloud consumer does not need to maintain resources on a local computing device. It is understood that the types of computing devices 54A-N shown in FIG. 1 are intended to be illustrative only and that computing nodes 10 and cloud computing environment 50 can communicate with any type of computerized device over any type of network and/or network addressable connection (e.g., using a web browser).

Figure 2:
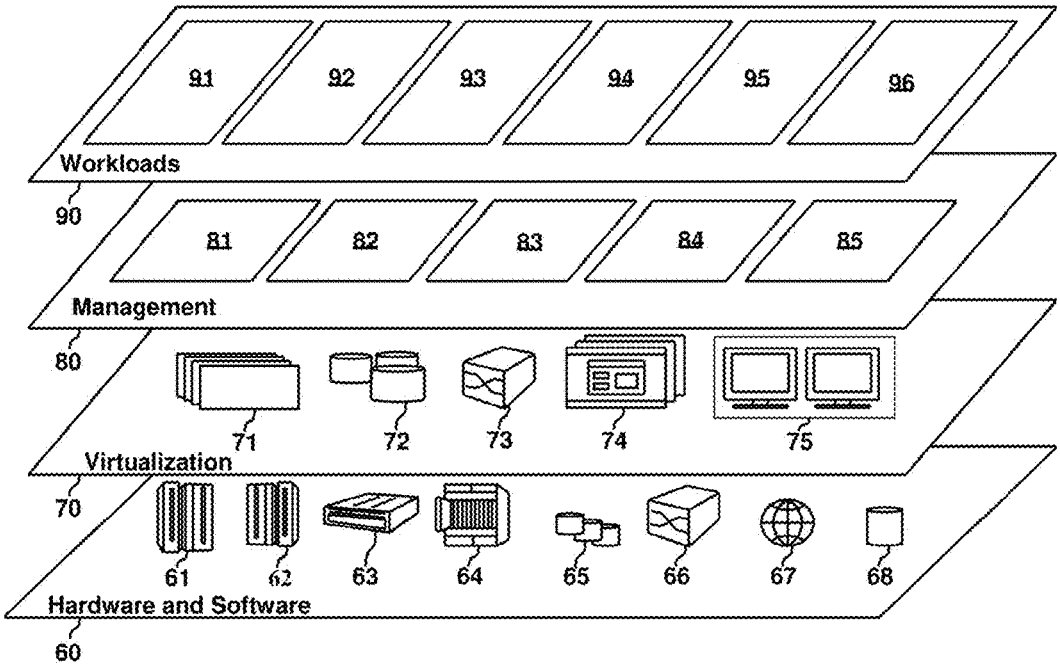
FIG. 2 depicts abstraction model layers according to an embodiment of the present invention.

Referring now to FIG. 2, a set of functional abstraction layers provided by cloud computing environment 50 (FIG. 1) is shown. It should be understood in advance that the components, layers, and functions shown in FIG. 2 are intended to be illustrative only and embodiments of the invention are not limited thereto. As depicted, the following layers and corresponding functions are provided:

Hardware and software layer 60 includes hardware and software components. Examples of hardware components include: mainframes 61; RISC (Reduced Instruction Set Computer) architecture based servers 62; servers 63; blade servers 64; storage devices 65; and networks and networking components 66. In some embodiments, software components include network application server software 67 and database software 68.

Virtualization layer 70 provides an abstraction layer from which the following examples of virtual entities may be provided: virtual servers 71; virtual storage 72; virtual networks 73, including virtual private networks; virtual applications and operating systems 74; and virtual clients 75.

In one example, management layer 80 may provide the functions described below. Resource provisioning 81 provides dynamic procurement of computing resources and other resources that are utilized to perform tasks within the cloud computing environment. Metering and Pricing 82 provide cost tracking as resources are utilized within the cloud computing environment, and billing or invoicing for consumption of these resources. In one example, these resources may include application software licenses. Security provides identity verification for cloud consumers and tasks, as well as protection for data and other resources. User portal 83 provides access to the cloud computing environment for consumers and system administrators. Service level management 84 provides cloud computing resource allocation and management such that required service levels are met. Service Level Agreement (SLA) planning and fulfillment 85 provides pre-arrangement for, and procurement of, cloud computing resources for which a future requirement is anticipated in accordance with an SLA.

Workloads layer 90 provides examples of functionality for which the cloud computing environment may be utilized.

Examples of workloads and functions which may be provided from this layer include: mapping and navigation 91; software development and lifecycle management 92; virtual classroom education delivery 93; data analytics processing 94; transaction processing 95; and driver warning 96.

Figure 5:
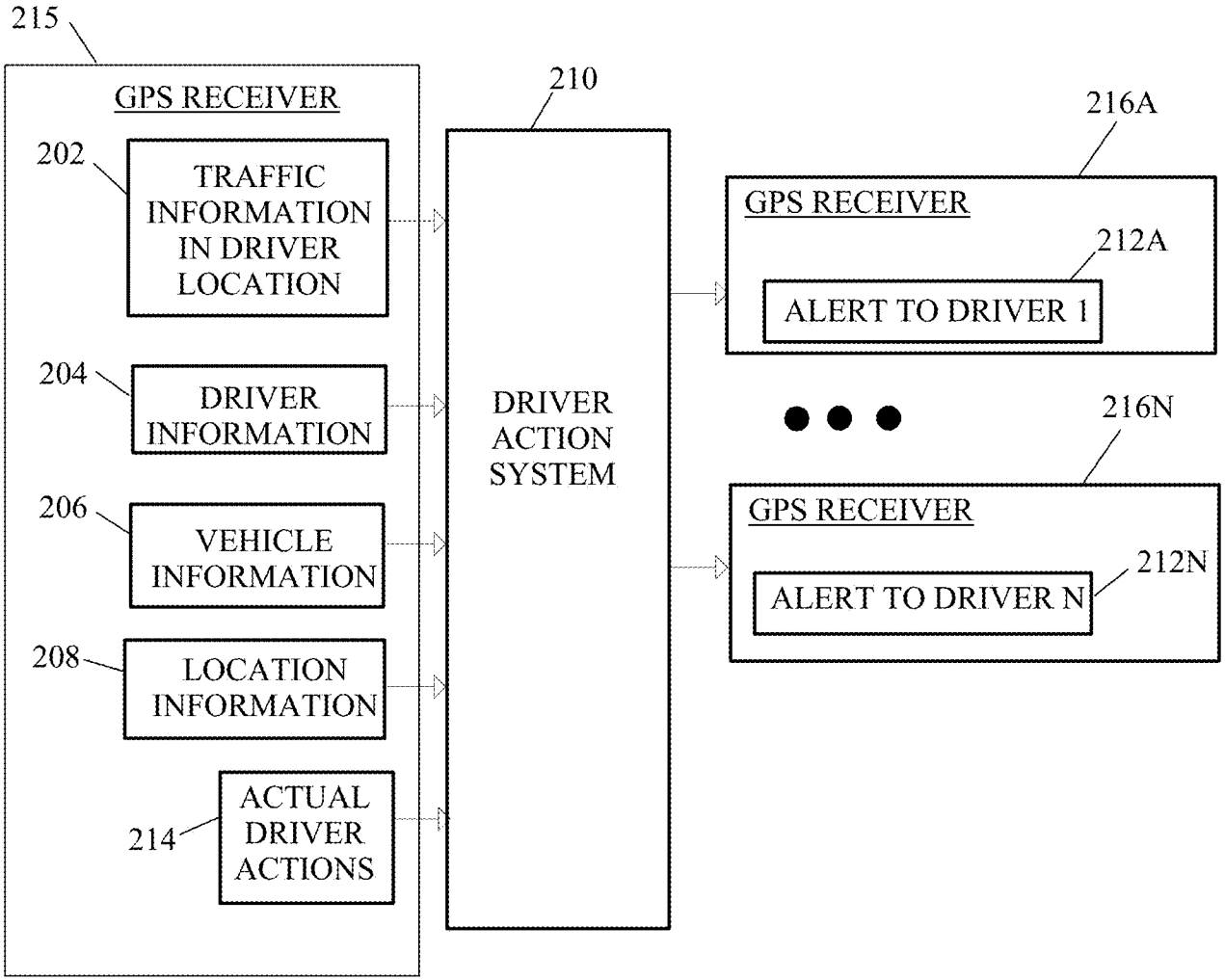
FIG. 5 shows a schematic of input received by the driver action system.

FIG. 5 shows a schematic of the driver action system. The driver action system 210 receives input from a GPS receiver 215 of a first user or driver and provides enrichment to a GPS receiver 216A of another user/driver by collecting data from drivers at different locations and determining driver patterns at that location accounting for time, weather, and type of car. The input may include, but is not limited to location information 208, traffic information in driver location 202, driver information 204, vehicle information 206, actual driver actions 214, weather, daylight and road conditions. The driver action system 210 can use cognitive analysis which exploits tradeoff analytics. Through cognitive analysis, the system can determine the probable movements of a driver that frequents an area on a regular basis. The data can be gathered by smartphones, cars, GPS receivers 216A-216N or other IoT wearables. Tradeoff analytics is a service that helps people make decisions when balancing multiple objectives. The service uses a mathematical filtering technique called "Pareto Optimization" that enables users to explore tradeoffs when considering multiple criteria for a single decision. With Tradeoff Analytics, users can avoid lists of endless options and identify the right option by considering multiple objectives.

The driver action system 210 outputs an alert to drivers 212A-212N via an IoT device such as GPS receiver 216A-216N. By alerting the drivers 212A-212N to possible actions of other drivers in the area, the problem of one driver not knowing the probabilities of any given action a driver intends to take is solved and those around that driver can make educated decisions.

Actual driver actions 214 may be used within a learning loop. The GPS receiver 215 can capture an individual driver's driving patterns. Additional sensors can be used to supplement that with information such as time of day, weather, sunlight, traffic, and timestamp that information. The sensors may be part of the GPS receiver or part of another system. The GPS receiver 215 will then capture subsequent activities in the same manner and use that as input to generate patterns for the driver resulting in a learning loop. This loop will continue until a person reaches their final destination, which will mark the completion of a trip segment that will make the data from that trip segment available for consumption by the learning loop. By using the actual actions of the driver, and situational conditions, such as time of day, weather, daylight available, and/or road conditions, the degree or level of confidence in predicting the driver's action in a given area or situation is increased.

Figure 3:
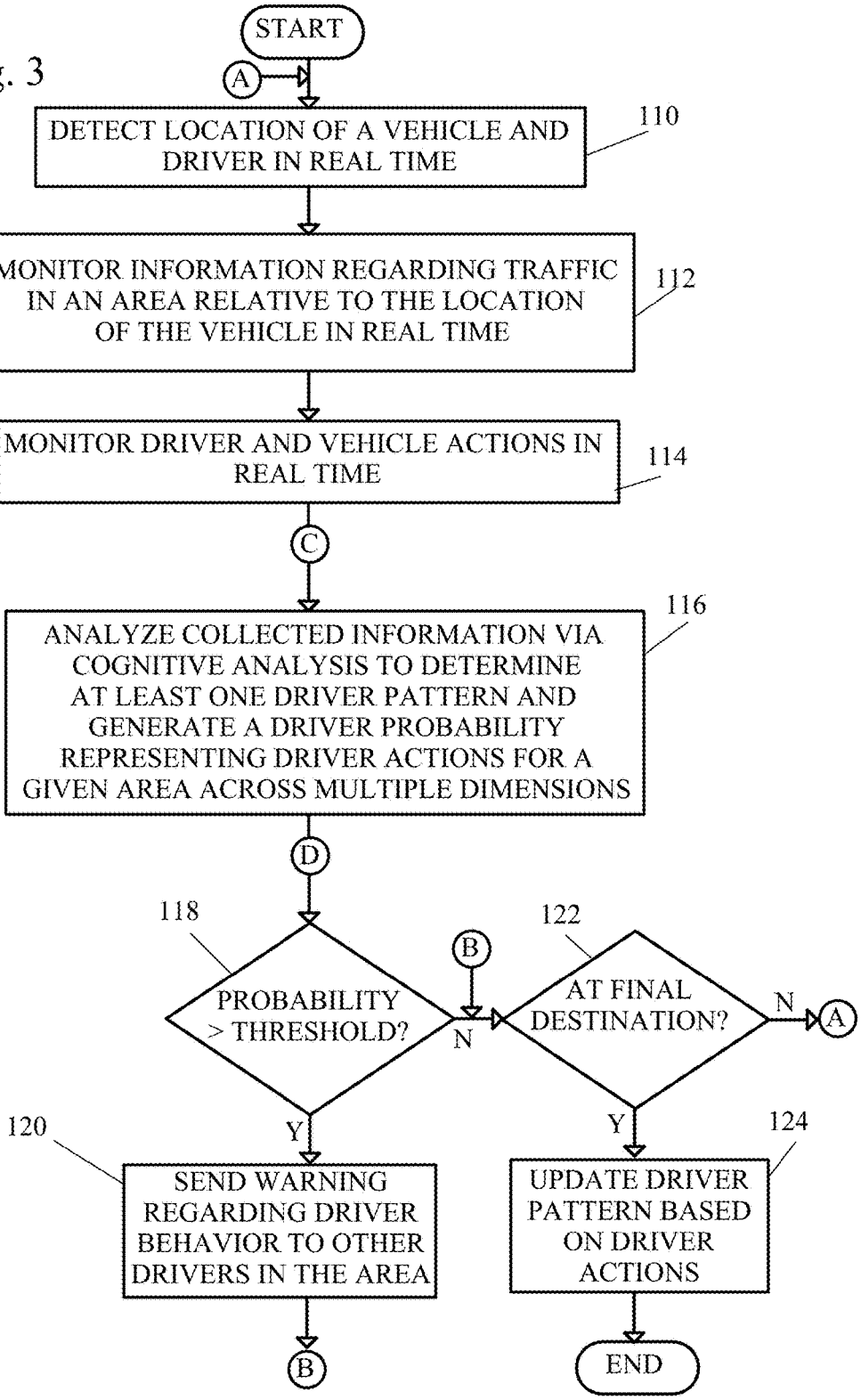
FIG. 3 shows a flow diagram of a method of warning drivers of intent of other drivers.

FIG. 3 shows a flow diagram of a method of warning drivers of intent of other drivers.

A location of a vehicle and driver is detected in real time (step 110). The location may be determined by location services of an IoT device, such as a smartphone or GPS receiver of a global positioning system.

Information regarding traffic in an area relative to the location of the vehicle in real time is monitored (step 112). The information is sent to the driver action system 210. The information may be, but is not limited to physical aspects of the road and traffic flow, daylight available, weather conditions, number of cars in a given area, length of lights, road conditions, and time of day.

The driver and vehicle actions are monitored in real time (step 114). The actions are sent to the driver action system 210. The driver and vehicle actions may be monitored through IoT sensors which may be present within the vehicle and/or worn by the user while operating the vehicle.

The collected information is analyzed via cognitive analysis to determine at least one driver pattern and generate a driver probability representing driver actions for a given area or location across multiple dimensions (step 116). The driver probability is calculated based on historical actions of the driver, current driver tendencies or behavior, location of the driver, road conditions, weather, time of day and other factors. The driver probability increases in accuracy the more a driver frequents an area.

Figure 4:
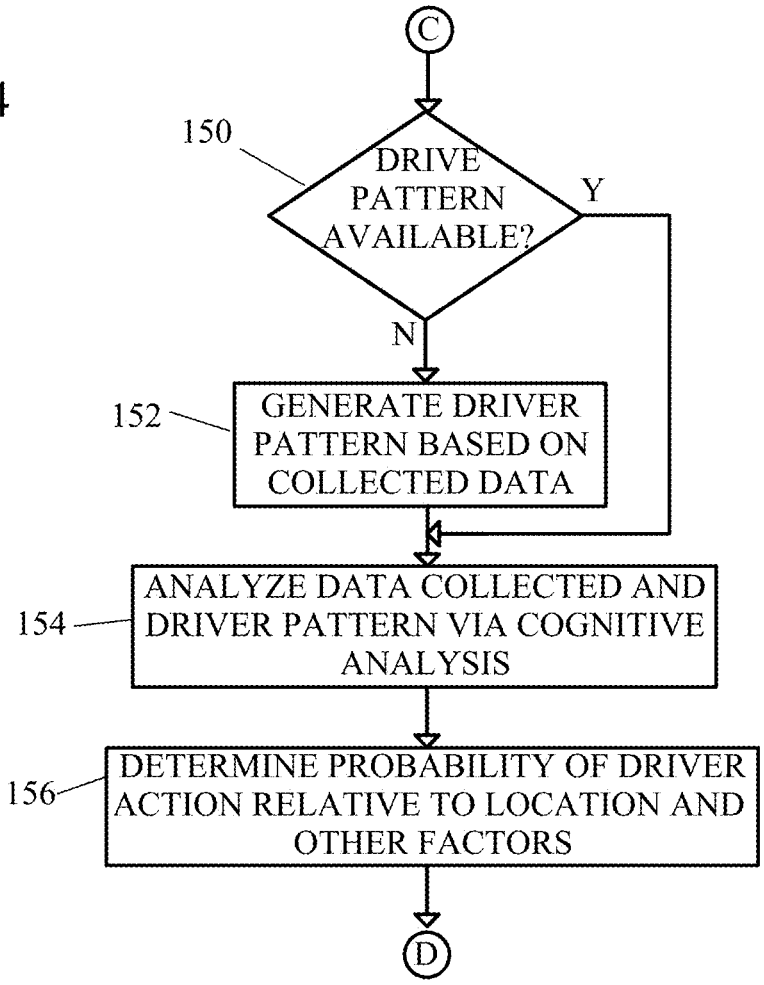
FIG. 4 shows a flow diagram of a method of analyzing collected information.

FIG. 4 shows a flow diagram of a method of analyzing collected information of step 116.

If a driver pattern is not available (step 150), a driver pattern is generated based on the collected data (step 152).

Data collected and the established driver pattern for the driver is analyzed via cognitive analysis (step 154).

A probability of a driver action relative to the location and other factors is determined (step 156) and the method continues onto step 118.

If the driver pattern is available (step 150), the method continues from step 154.

If the driver probability is less than a threshold (step 118), and if the driver is at a final destination (step 122), the driver pattern associated with the driver is updated based on driver actions within the area or location (step 124) and the method ends.

If the driver is not at the final destination (step 122), the method returns to step 110.

If the driver probability is greater than a threshold (step 118), a warning regarding the driver behavior is sent to other drivers in the area which may be impacted by the driver behavior to be consumed (step 120) and the method returns to step 122. The threshold may be set by an administrator or by each individual driver, where the individual driver can determine whether they receive a warning for less than 20% or 40% probability that an action will occur.

The drivers may receive or consume the warning via IoT sensors. For example, the driver of other vehicles may receive a warning through their GPS receiver indicating that there is a probability of another driver performing an action which is not expected and could cause them harm while driving within the area. The warning may additionally be sent to a smartwatch or smartphone. The warning may include a degree of probability of whether the other driver will perform an action, for example high, low or medium warning.

The consuming IoT sensors that receive the warnings will calculate the probability of a problem based on the tendencies of vehicles in the area and the probability that action will need to be taken by the consuming driver because of the speed and direction of the consuming driver and the driver about which the warning is sent. Based on the output of the calculation, the IoT sensor will alert a driver to take an action based on that risk with the alert type variable based on the level of risk.

EXAMPLE 1

Driver A is leaving a gym. Across from the gym is a highway entrance, though a solid line is present to prevent people from going to that entrance from a particular side of the street. Historical driver pattern for Driver A shows that on Sundays, Driver A crosses the line 90% of the time, but at all other times during the week, Driver A obeys the law.

On Sundays, the driver action system can transmit to oncoming vehicles, through the GPS receiver of Driver A's vehicle, that there is a 90% possibility that Driver A will be aggressive and may cut them off to access the highway entrance by crossing the solid line. The GPS receivers of the oncoming vehicles will consume that data and warn their drivers of the probable risk. On the other days of the week, the driver action system determines that Driver A obeys the law, acting as expected and no additional warnings will need to be transmitted to the oncoming vehicles and their drivers.

EXAMPLE 2

Driver D is in a vehicle. Driver D has demonstrated a propensity for making wide right-hand turns. Through the driver action system, this behavior will be shared with vehicles in the area so cars coming in the opposite direction know that when Driver D makes a right turn, there is a 40% chance of going into the lane of oncoming vehicles. Based on the probability of Driver D displaying this behavior, the warning conveyed to drivers of oncoming vehicles may be lower than if the probability were higher.

EXAMPLE 3

Driver B is an aggressive driver and avoids backups at exit ramps by merging into the line very close to the exit of the exit ramp. Driver B exhibits this behavior 80% of the time during daylight hours in good weather, but only 10% at night or in bad weather. As Driver B is approaching the exit ramp that he usually gets off, his tendencies are broadcast to vehicles in the area through the driver action system and the risk is displayed appropriately to vehicles in the area through their GPS receivers based on the probability of an interaction with Driver B.

EXAMPLE 4

Driver C is in a rental car at a location that Driver C does not normally frequent. History shows that Driver C will make hard stops or quick turns 15% of the time to adjust his route at spots that his GPS receiver recommends a turn. Drivers following Driver C would be notified that quick stops or lane changes could happen when approaching an intersection where Driver C must make a turn. While this is a low risk, the system provides additional input for local drivers in regards to Driver C's behavior.

It should be noted that while the examples given were in regards to providing other drivers information about a current driver and their vehicle, those skilled in the art would recognize that the warnings could also be sent to IoT devices of users on a bicycle or walking, with warnings that someone may pull into a parking lot or go through an intersection a person is traveling through.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

What is claimed is:

1. A method of warning drivers of intent of other drivers in an area comprising the steps of:

a computer detecting a location of a vehicle and a first driver in real time;

the computer monitoring traffic and road conditions in the location of the vehicle in real time;

the computer analyzing information collected during monitoring via cognitive analysis to determine at least one driver pattern of the first driver wherein the at least one driver pattern includes probable movements of the first driver in a given location accounting for location, time of day, weather and type of car and to generate a driver probability representing driver actions of the first driver for the given location; and if the driver probability is greater than a threshold, sending a warning regarding the at least one driver pattern to at least one second driver in the location which may be impacted by the first driver.

2. The method of claim 1, wherein the warning is sent via IoT sensors.

3. The method of claim 1, wherein the warning is received by the at least one second driver via a global positioning receiver of a global positioning system in a vehicle being driven by the at least one second driver.

4. The method of claim 1, wherein the driver probability is based on at least historical actions of the first driver.

5. The method of claim 1, wherein once the first driver reaches a final destination, the driver actions of the first driver are used to learn driver behaviors of the first driver and to update the at least one driver pattern.

6. The method of claim 1, wherein the warning includes an action for the second driver to take based on a level of risk to the second driver.

7. A computer program product for warning drivers of intent of other drivers in an area, a computer comprising at least one processor, one or more memories, one or more computer readable storage media, the computer program product comprising a computer readable storage medium having program instructions embodied therewith, the program instructions executable by the computer to perform a method comprising:

detecting, by the computer, a location of a vehicle and a first driver in real time;

monitoring, by the computer, traffic and road conditions in the location of the vehicle in real time;

analyzing, by the computer, information collected during monitoring via cognitive analysis to determine at least one driver pattern of the first driver wherein the at least one driver pattern includes probable movements of the first driver in a given location accounting for location, time of day, weather and type of car and to generate a driver probability representing driver actions of the first driver for the given location; and if the driver probability is greater than a threshold, sending, by the computer, a warning regarding the at least one driver pattern to at least one second driver in the location which may be impacted by the first driver.

8. The computer program product of claim 7, wherein the warning is sent via IoT sensors.

9. The computer program product of claim 7, wherein the driver probability is based on at least historical actions of the first driver.

10. The computer program product of claim 7, wherein once the first driver reaches a final destination, the driver actions of the first driver are used to learn driver behaviors of the first driver and to update the at least one driver pattern.

11. The computer program product of claim 7, wherein the warning includes an action for the second driver to take based on a level of risk to the second driver.

12. The computer program product of claim 7, wherein the warning is received by the at least one second driver via a global positioning receiver of a global positioning system in a vehicle being driven by the at least one second driver.

13. A computer system for warning drivers of intent of other drivers in an area, the computer system comprising a computer comprising at least one processor, one or more memories, one or more computer readable storage media having program instructions executable by the computer to perform the program instructions comprising:

detecting, by the computer, a location of a vehicle and a first driver in real time;

monitoring, by the computer, traffic and road conditions in the location of the vehicle in real time;

analyzing, by the computer, information collected during monitoring via cognitive analysis to determine at least one driver pattern of the first driver wherein the at least one driver pattern includes probable movements of the first driver in a given location accounting for location, time of day, weather and type of car and to generate a driver probability representing driver actions of the first driver for the given location; and if the driver probability is greater than a threshold, sending, by the computer, a warning regarding the at least one driver pattern to at least one second driver in the location which may be impacted by the first driver.

14. The computer system of claim 13, wherein the warning is sent via IoT sensors.

15. The computer system of claim 13, wherein the driver probability is based on at least historical actions of the first driver.

16. The computer system of claim 13, wherein once the first driver reaches a final destination, the driver actions of the first driver are used to learn driver behaviors of the first driver and to update the at least one driver pattern.

17. The computer system of claim 13, wherein the warning includes an action for the second driver to take based on a level of risk to the second driver.

18. The computer system of claim 13, wherein the warning is received by the at least one second driver via a global positioning receiver of a global positioning system in a vehicle being driven by the at least one second driver.

* * * * *